US005971063A

United States Patent [19]

Treppler

[11] Patent Number: 5,971,063

[45] Date of Patent: Oct. 26, 1999

[54] VAPOR CONDENSER

[75] Inventor: Marc Treppler, St. Louis, Mo.

[73] Assignee: The Mart Corporation, Maryland Heights, Mo.

[21] Appl. No.: 08/655,452

[22] Filed: May 30, 1996

[51] Int. Cl.[6] ..... F28B 1/00

[52] U.S. Cl. ..... 165/110; 165/302; 95/225; 261/131; 261/117

[58] Field of Search ..... 137/93, 94; 261/117, 261/131, 66; 165/110, 302, 10, 8, 5; 95/224, 225

[56] References Cited

U.S. PATENT DOCUMENTS

| | | | |
|---|---|---|---|
| 247,501 | 9/1881 | Knowles | 165/302 |
| 728,777 | 5/1903 | Sconfietti | 261/117 |
| 3,456,709 | 7/1969 | Vegeby | 261/117 |
| 3,660,980 | 5/1972 | Knirsch et al. | 261/131 X |
| 3,760,871 | 9/1973 | Larinoff | 165/110 |
| 3,887,666 | 6/1975 | Heller et al. | 261/131 X |
| 4,146,775 | 3/1979 | Kirchner et al. | 261/131 X |
| 4,854,129 | 8/1989 | Hickley et al. | 261/117 X |
| 5,097,889 | 3/1992 | Ritter | 165/5 |
| 5,213,152 | 5/1993 | Cox | 165/5 |
| 5,509,461 | 4/1996 | Williams | 165/8 |

FOREIGN PATENT DOCUMENTS

| | | | |
|---|---|---|---|
| 595499 | 10/1925 | France | 261/117 |
| 0257482 | 6/1988 | Germany | 165/110 |
| 851655 | 10/1960 | United Kingdom | 95/225 |

*Primary Examiner*—Christopher Atkinson
*Attorney, Agent, or Firm*—Wood, Phillips, VanSanten, Clark & Mortimer

[57] ABSTRACT

A vapor condenser includes a conduit defining a passage for guidingly communicating a vapor stream in a vapor flow direction from an inlet at a first location to a second location, a first heat exchanger between the first and second locations for open heat exchange between the vapor and a first coolant, the first coolant flowing in a direction that is counter to the vapor flow direction, and a second heat exchanger between the first and second locations for open heat exchange between the vapor and a second coolant. The vapor condenser automatically controls the flow rate of coolant in the first heat exchanger in response to changes in the density of the vapor in the vapor stream entering the conduit. Control of the flow rate of coolant is maintained, for example, by controlling the flow rate of individual dispersal devices, such as nozzles, or by controlling the number of nozzles operating.

8 Claims, 4 Drawing Sheets

VAPOR CONDENSER

FIELD OF THE INVENTION

The present invention is directed to a vapor condenser, and in particular to a vapor condenser including an open, counter-flowing heat exchange system and a two-stage heat exchange system for the condensation of a vapor stream.

BACKGROUND OF THE INVENTION

Many commercial and industrial processes generate as by-products large amounts of vapor, such as steam, during operation. As is the case with the by-products of any commercial or industrial process, the vapor produced must eventually be released for disposal in the surrounding environment.

One disposal method is to exhaust the vapor stream directly to the ambient environment. This method, however, has come under increased scrutiny by federal, state, and local regulatory authorities, leading to legal restrictions being placed on the disposal of vapor in this manner. Most commonly, a permit is required to exhaust vapor streams to the ambient environment. Sometimes, such a permit is difficult to obtain.

Even if a permit is obtained to exhaust the vapor by-products of an industrial process to the ambient environment, the physical requirements of such an exhaust system often create additional problems. For example, the exhaust stack may interfere with the motion of other machinery, such as an overhead crane. Additionally, the process generating the vapor to be exhausted may be located a great distance from an external wall, requiring an extensive system of duct work to be installed.

Alternatively, the vapor stream by-products could be released within the plant where the commercial or industrial process is being practiced. However, such a disposal method may result in a dangerous environment for the employees working in the surrounding area of the plant, unless the vapor content or density of the vapor stream is somehow limited before the stream is released into the plant surroundings.

SUMMARY OF THE INVENTION

In an aspect of the present invention, a vapor condenser has a conduit defining a passage for guidingly communicating a vapor stream in a vapor flow direction from a first location to a second location, and a mechanism for delivering a first coolant into the passage between the first and second locations in a first coolant flow direction that is counter to the vapor flow direction.

The vapor condenser may be combined with a supply of a first coolant.

The vapor condenser may have the first coolant delivery mechanism with a mechanism for producing a coolant spray in the passage.

The vapor condenser may have a mechanism for delivering a second coolant into the passage between the first and second locations.

The vapor condenser may have the first coolant delivery mechanism with a mechanism for dispersing a first coolant in the passage, a mechanism for selectively supplying the coolant dispersing mechanism with a first coolant at a first pressure to produce a first coolant flow rate in the passage, and for selectively supplying the coolant dispersing mechanism with a first coolant at a second pressure to produce a second coolant flow rate in the passage, a mechanism for determining the existence of each of a) a first vapor state and b) a second vapor state in the passage, and a mechanism for controlling the coolant supplying mechanism to supply the coolant dispersing mechanism with a first coolant at the first pressure to produce a first first coolant flow rate as an incident of the determining mechanism determining the existence of the first vapor state in the passage, and to supply the coolant dispersing mechanism with a first coolant at the second pressure to produce a second first coolant flow rate as an incident of the determining mechanism determining the existence of the second vapor state in the passage.

Moreover, the first vapor state may be a first vapor density in the vapor stream, and the second vapor state a second vapor density in the vapor stream, the first and second vapor densities being different.

Moreover, the vapor condenser may be combined with a parts washer having first and second operating states which cause the first and second vapor states in the vapor stream, and have means for determining the first vapor state as an incident of sensing the first operational state of the parts washer and determining the second vapor state as an incident of sensing the second operational state of the parts washer.

The vapor condenser may have the first coolant delivery mechanism with first and second mechanisms for dispersing a first coolant in the passage, a mechanism for selectively supplying the first coolant dispersing mechanism with a first coolant to produce a first first coolant flow rate in the passage, and for selectively supplying the first and second coolant dispersing mechanisms with a first coolant to produce a second first coolant flow rate in the passage, a mechanism for determining the existence of each of a) a first vapor state and b) a second vapor state in the passage, and a mechanism for controlling the coolant supplying mechanism to supply the first coolant dispersing mechanism with a first coolant to produce a first first coolant flow rate as an incident of the determining mechanism determining the existence of the first vapor state, and to supply the first and second dispersing mechanisms with a first coolant to produce a second first coolant flow rate as an incident of the determining mechanism determining the existence of the second vapor state in the passage.

The vapor condenser may have a mechanism for inducing flow of the vapor stream in the vapor flow direction from the first location to the second location.

Moreover, the vapor condenser may have the flow inducing mechanism with a mechanism for generating a first pressure at the first location and a second pressure at the second location to draw the vapor stream from the first location to the second location.

Moreover, the vapor condenser may have the flow inducing mechanism with a mechanism for generating a first pressure at the first location and a second pressure at the second location to propel the vapor stream from the first location to the second location.

In another aspect of the present invention, a vapor condenser has a conduit defining a passage for guidingly communicating a vapor stream in a vapor flow direction from a first location to a second location, a mechanism for delivering a first coolant into the passage between the first and second locations, and a mechanism for delivering a second coolant into the passage between the first and second locations.

The vapor condenser may have a first coolant delivery mechanism with a mechanism for dispersing a first coolant into the passage between the first and second locations in a first coolant flow direction that is counter to the vapor flow direction.

Moreover, the vapor condenser may have the first coolant delivery mechanism with a mechanism for selectively supplying the coolant dispersing mechanism with a first coolant at a first pressure to produce a first first coolant flow rate in the passage, and for selectively supplying the coolant dispersing mechanism with a first coolant at a second pressure to produce a second first coolant flow rate in the passage, a mechanism for determining the existence of each of a) a first vapor state and b) a second vapor state in the passage, and a mechanism for controlling the coolant supplying mechanism to supply the coolant dispersing mechanism with a first coolant at the first pressure to produce a first first coolant flow rate as an incident of the determining mechanism determining the existence of the first vapor state in the passage, and to supply the coolant dispersing mechanism with a first coolant at the second pressure to produce a second first coolant flow rate as an incident of the determining mechanism determining the existence of the second vapor state in the passage.

The vapor condenser may have the first coolant delivery mechanism with first and second mechanisms for dispersing a first coolant into the passage between the first and second locations in a first coolant flow direction that is counter to the vapor flow direction.

Moreover, the vapor condenser may have the first coolant delivery mechanism with a mechanism for selectively supplying the first coolant dispersing mechanism with a first coolant to produce a first first coolant flow rate in the passage, and for selectively supplying the first and second coolant dispersing mechanisms with a first coolant to produce a second first coolant flow rate in the passage, a mechanism for determining the existence of each of a) a first vapor state and b) a second vapor state in the passage, and a mechanism for controlling the coolant supplying mechanism to supply the first coolant dispersing mechanism with a first coolant to produce a first first coolant flow rate as an incident of the determining mechanism determining the existence of the first vapor state, and to supply the first and second dispersing mechanisms with a first coolant to produce a second first coolant flow rate as an incident of the determining mechanism determining the existence of the second vapor state in the passage.

The vapor condenser may remove a significant amount of heat from an incoming vapor stream so as to limit the vapor content or density of the exiting stream.

The vapor condenser may limit the vapor content of a vapor stream while requiring a relatively small amount of space for such a condenser.

In one form, the vapor condenser may automatically respond to changes in a vapor stream by controlling the method of vapor removal.

DESCRIPTION OF THE PREFERRED EMBODIMENTS

Figure 1:
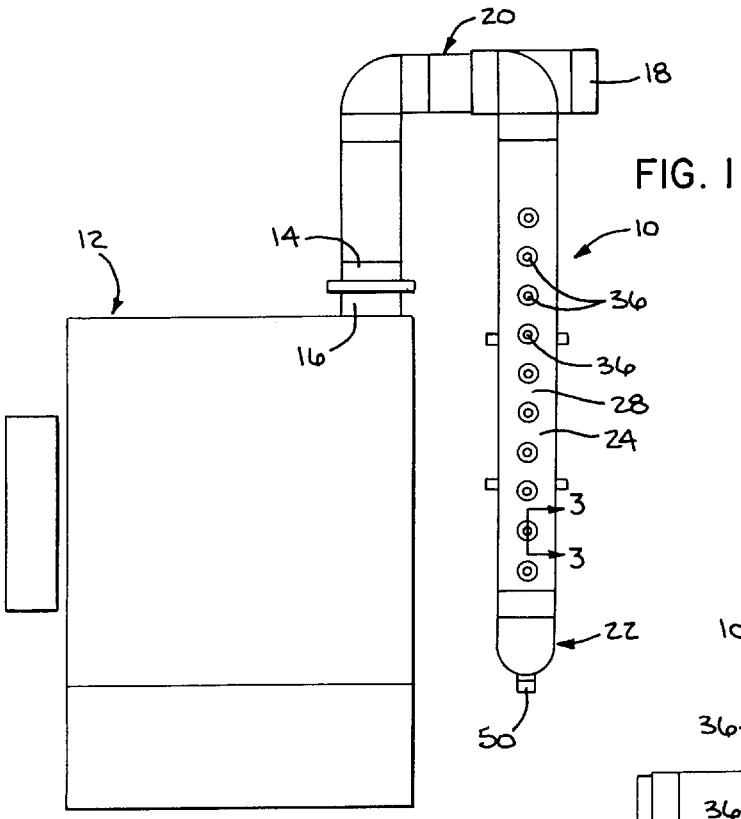
FIG. 1 is an elevation view showing an embodiment of the present invention attached to a parts washer, with the support structure attaching the embodiment of the present invention to the parts washer removed to better expose the detail of this embodiment of the present invention.

According to a preferred embodiment of the present invention, a vapor condenser 10 is shown, by way of illustration, attached to a parts washer 12, such as that shown in U.S. Pat. No. 5,427,128, the disclosure of which is incorporated herein by reference. The vapor condenser 10 has an inlet 14 attached to an exhaust 16 of the parts washer 12, preferably by bolting a flange on the inlet 14 to a flange on the exhaust 16. The vapor condenser 10 exhausts to the surrounding environment through a T-shaped outlet 18.

The vapor condenser 10 includes a conduit defining a passage for guidingly communicating the vapor including two U-shaped sections 20, 22 connected, preferably by welding, to a first straight section 24 and a second straight section 26, the U-shaped sections 20, 22 and straight sections 24, 26 preferably manufactured of polyvinyl chloride (PVC). A first open, coolant-to-fluid heat exchanger or coolant delivery system 28 is fitted to the first straight section 24, and a second open, coolant-to-fluid heat exchanger or coolant delivery system 30 is fitted to the second straight section 26. The second coolant-to-fluid heat exchanger 30 is also used to move the vapor stream through the vapor condenser 10 from the inlet 14 to the outlet 18.

In particular, preferably a venturi fan 32 is used to move the vapor stream by generating a pressure differential between the outlet 18 and the inlet 14 of the vapor condenser 10. Most preferably, the venturi fan 32, bolted to flanges provided in the straight section 26, is an 8 inch, ½ horsepower venturi fan with a capacity of between 300 and 600 cubic feet/minute. The difference in pressures between the inlet 14 and the outlet 18 generated by the venturi fan 32 causes the vapor stream to be drawn from the parts washer 12. Other mechanisms of moving the vapor stream can be used with this embodiment of the present invention, such as a systems which create a pressure differential to propel the vapor stream rather than to draw the vapor stream from the parts washer 12.

Figure 2:
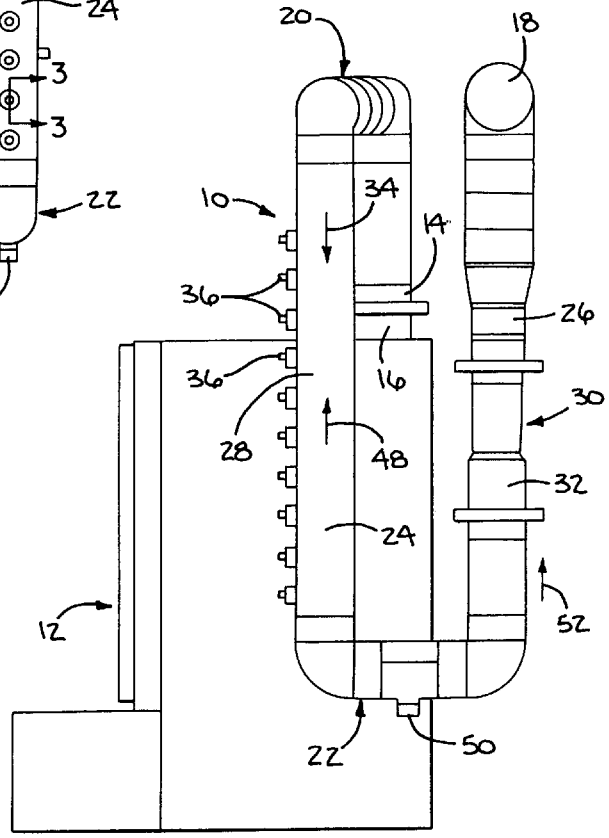
FIG. 2 is a second elevation view showing the embodiment of FIG. 1 attached to a parts washer with the support structure attaching the embodiment of the present invention to the parts washer removed to better expose the detail of this embodiment of the present invention.
Figure 3:
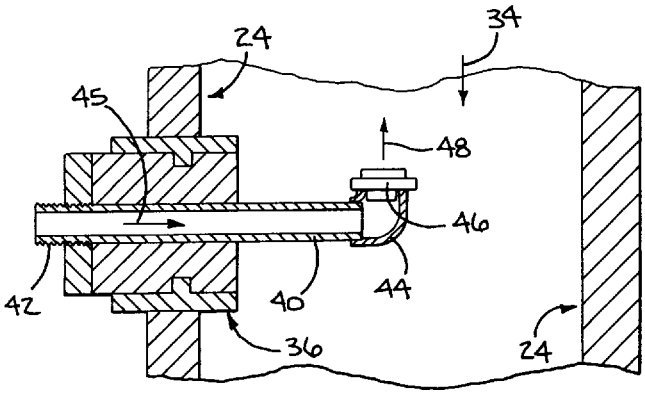
FIG. 3 is a cross-sectional view of a nozzle arrangement useful in the embodiment shown in FIG. 1 taken about line 3—3 in FIG. 1.

The vapor stream first passes into the U-shaped section 20, and from the U-shaped section 20 into the first straight section 24. As shown in FIGS. 2 and 3, the flow of the vapor stream is in the direction of the arrow 34 as the stream enters the first coolant-to-fluid heat exchanger 28.

Figure 4:
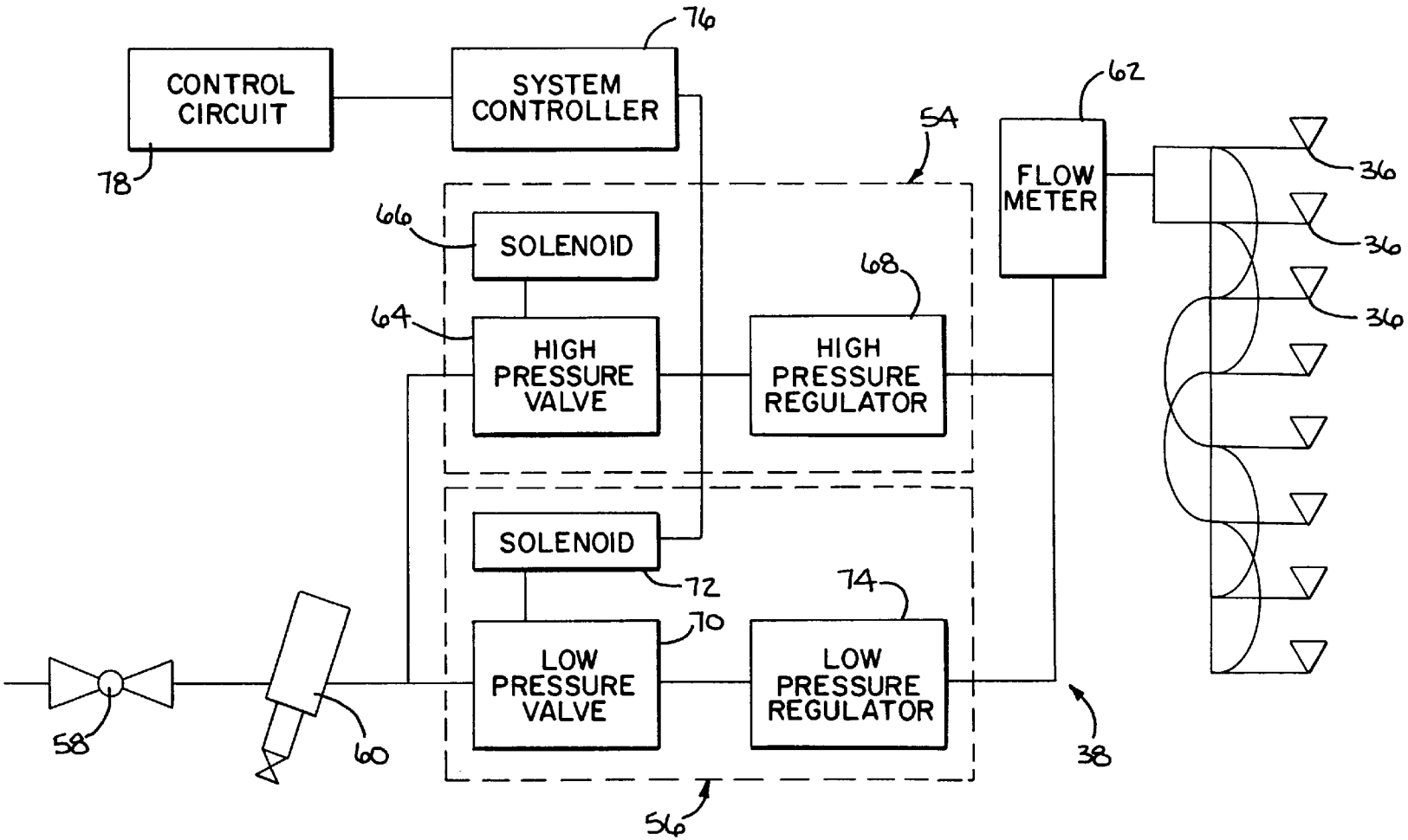
FIG. 4 is a schematic view of an embodiment of a coolant pressure regulation and control system for use with the present invention.
Figure 5:
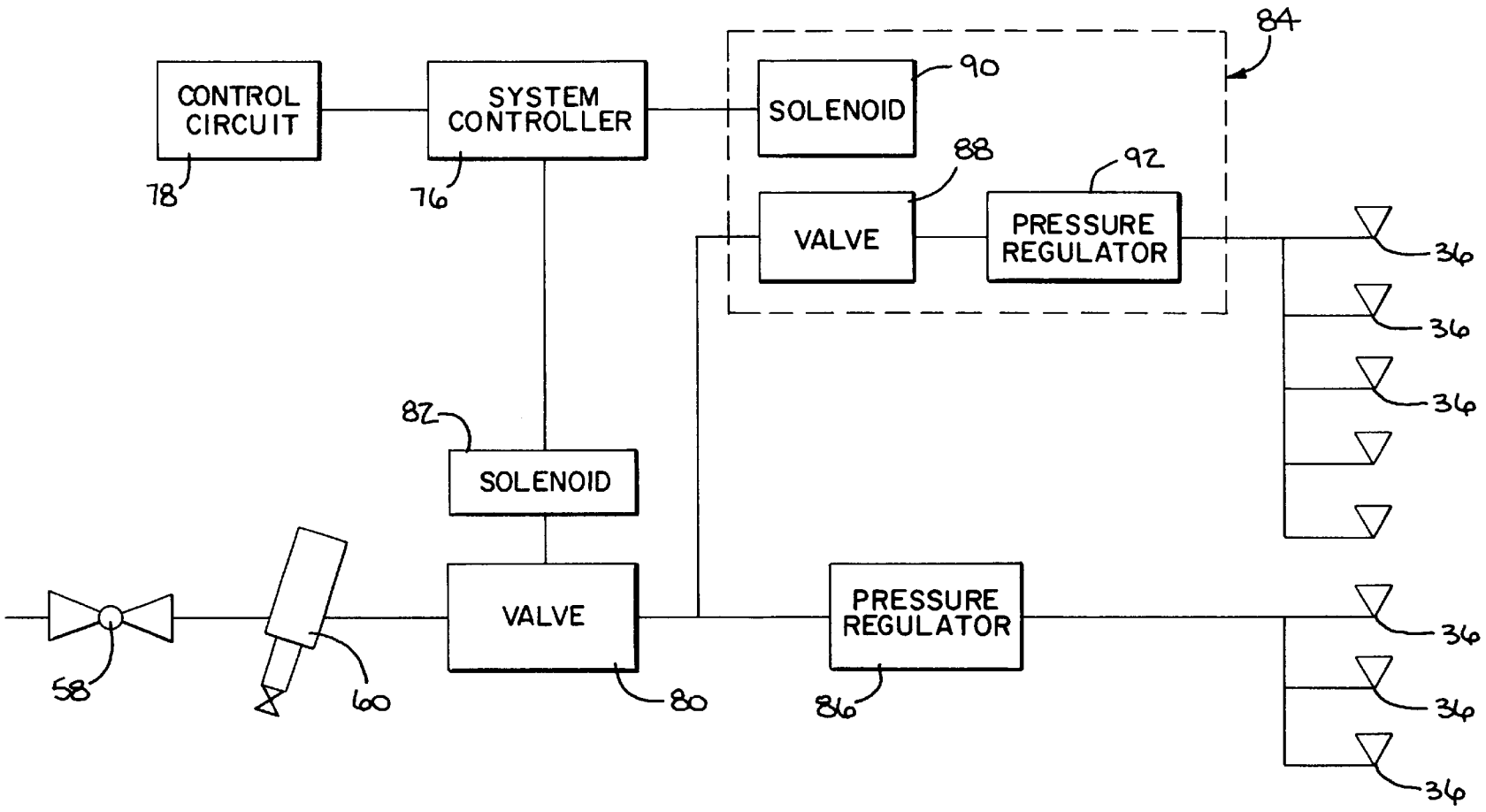
FIG. 5 is a schematic view of another embodiment of a coolant pressure regulation and control system for use with the present invention.

The first coolant-to-fluid heat exchanger 28 includes at least one, but more preferably a plurality of, nozzle arrangements 36 attached to a pressure regulation and control system 38, as shown in FIGS. 4 & 5. The nozzle arrangements 36, as shown in FIG. 3, each include a tubular section 40 with a threaded engagement section 42 at one end and an elbow joint 44 at the other end. Coolant flowing through the tubular section 40 in the direction of the arrow 45 enters the elbow joint 44, and is directed upwards at a 90 degree angle to the tubular section 40 through a dispersal device or spray nozzle 46 at the distal end of the elbow joint 44.

Coolant from the pressure regulation and control system 38 flows through the nozzle arrangement 36 and exits the spray nozzle 46 as a coolant spray or spray of coolant droplets in the direction of the arrow 48, as shown in FIGS. 2 and 3. As can be seen, the direction of the coolant flow, shown by the arrow 48, is directly opposite or counter the flow of the vapor stream, shown by the arrow 34.

The counter-flowing coolant serves two purposes as it collides with the oncoming vapor stream. First, the coolant removes a large amount of heat at an extremely high heat transfer rate through direct, open heat transfer between the coolant and the stream exiting the parts washer 12. Second, the coolant scrubs, or removes harmful vapors from, the exiting vapor stream.

The stream of at least partially condensed vapor flows under the influence of gravity to the bight of the U-shaped section 22, where the condensed vapor exits from the vapor condenser 10 via a release valve 50. Tests run on part washers 12, such as that disclosed in U.S. Pat. No. 5,427,128, have shown that the levels of metals or other hazardous substances in the vapor stream leaving the parts washer 12 are significantly below the detection levels set by the Environmental Protection Agency and the Occupational Health and Safety Administration. As such, the stream of condensed vapor may be exhausted from the condenser 10 into a sewer. However, given that local regulations vary widely, discharge into a sewer should be verified with the appropriate authorities. In the alternative, the condensed vapor can be released through the valve 50 and collected for disposal.

The remainder of the vapor stream, greatly limited in its vapor content or density, flows through the U-shaped connection 22, and into the second straight section 26 in the direction of the arrow 52, as shown in FIG. 2. The stream passes through the venturi fan 32, where a second, open heat exchange occurs, this time between the stream of remaining vapor and air drawn from the ambient environment through intake vents in the venturi fan 32. The second stage of heat exchange causes the stream to cool even further before the stream exits from the vapor condenser 10 through the outlet 18.

According to one embodiment of the present invention, the coolant pressure regulation and control system 38 is shown in FIG. 4 for the automatic regulation of the flow of coolant into the first coolant-to-fluid heat exchanger 28 in response to sensed changes in the vapor content of the incoming stream. As shown in FIG. 4, the pressure regulation and control system 38 includes a high pressure regulator system 54 and a low pressure regulator system 56. The high and low pressure regulator systems 54, 56 are connected in parallel between a coolant inlet 58 and the nozzle arrangements 36.

Optionally, a strainer element 60 may be connected between the coolant inlet 58 and the parallel combination of the low pressure regulator system 56 and the high pressure regulator system 54 to remove any impurities in the coolant. Additionally, an optional rotameter or flow meter 62 may be connected between the parallel combination of the regulator systems 54, 56 and the nozzle arrangements 36 to monitor the flow rate of the coolant entering the nozzle arrangements 36.

The high pressure regulator system 54 includes a valve 64 controlled via a solenoid 66. The solenoid-controlled valve 64 is connected in series with a high pressure regulator 68. Similarly, the low pressure regulator system 56 includes a valve 70, a solenoid 72 and a low pressure regulator 74.

The solenoids 66, 72 are wired to a system controller 76, which in turn is wired directly to a control circuit 78 on the parts washer 12. In response to the operation of the parts washer 12 by the control circuit 78, the system controller 76 will activate solenoids 66, 72 to open and close the valves 64, 70, thereby automatically controlling the supply of coolant to the heat exchanger 28, and more particularly the nozzle arrangements 36, depending on sensed changes in the condition of the vapor stream from the parts washer 12.

For example, when the parts washer 12 is not operating, the system controller 76 will close both valves 64, 70. With valves 64, 70 closed, no coolant will enter the nozzle arrangements 36.

When the parts washer 12 is operating in its wash cycle, and the vapor content of the stream exiting the exhaust 16 is high, the system controller 76 signals the solenoid 72 to close the valve 70, while signalling the solenoid 66 to open the valve 64. With the valve 64 open, the coolant will flow through the high pressure regulator 68, causing coolant to flow to the nozzle arrangements 36 at a rate controlled by the high pressure regulator 68. Preferably, the flow rate entering the first coolant-to-fluid heat exchanger 28 is 5.25 gallons/minute.

When the parts washer 12 is idling, and the vapor content of the stream exiting the exhaust 16 is low, the system controller 76 signals the solenoid 66 to close the valve 64, while signalling the solenoid 72 to open the valve 70. With the valve 70 open, the coolant will flow through the low pressure regulator 74, causing the coolant to flow at a rate less than that achieved through the high pressure regulator 68. Preferably, the flow rate entering the first coolant-to-fluid heat exchanger 28 is 0.25 gallons/minute.

Alternatively, a second embodiment of the pressure regulation and control system 38 of the present invention is shown in FIG. 5, with those elements in common with the embodiment of the present invention shown in FIG. 4 numbered similarly. A valve 80, controlled by solenoid 82, is connected in series with the parallel combination of a pressure regulator system 84 and a first pressure regulator 86. The pressure regulator system 84 in turn includes a valve 88, a solenoid 90, and a second pressure regulator 92. The second pressure regulator 92 and the first pressure regulator 86 are both connected to a number of nozzle arrangements 36, the number of nozzle arrangements 36 connected to the second pressure regulator 92 being greater in number than the number of nozzle arrangements 36 connected to the first pressure regulator 86.

When the parts washer 12 is not operating, the system controller 76, which is connected to the solenoids 82, 90, signals both the solenoids 82, 90 to close the valves 80, 88. With the valves 80, 88 closed, no coolant enters the nozzle arrangements 36.

When the parts washer 12 is in the wash cycle, the system controller signals both the solenoids 82, 90 to open the valves 80, 88. With the valves 80, 88 open, coolant enters all of the nozzle arrangements 36.

When the parts washer 12 is idling, the system controller 76 signals the solenoid 82 to open the valve 80, while signalling the solenoid 90 to close the valve 88. With the valve 80 open and the valve 88 closed, the coolant will only flow through the first pressure regulator 86 and the nozzle arrangements 36 in series with the first pressure regulator 86. The advantage of the second embodiment of the pressure regulation and control system 38 is that the flow rate of the individual nozzle arrangements 36 can be maintained at a single level, while the flow rate of the coolant entering the first coolant-to-vapor heat exchanger 28 can be controlled by selecting how many nozzle arrangements 36 are operating.

Figure 6:
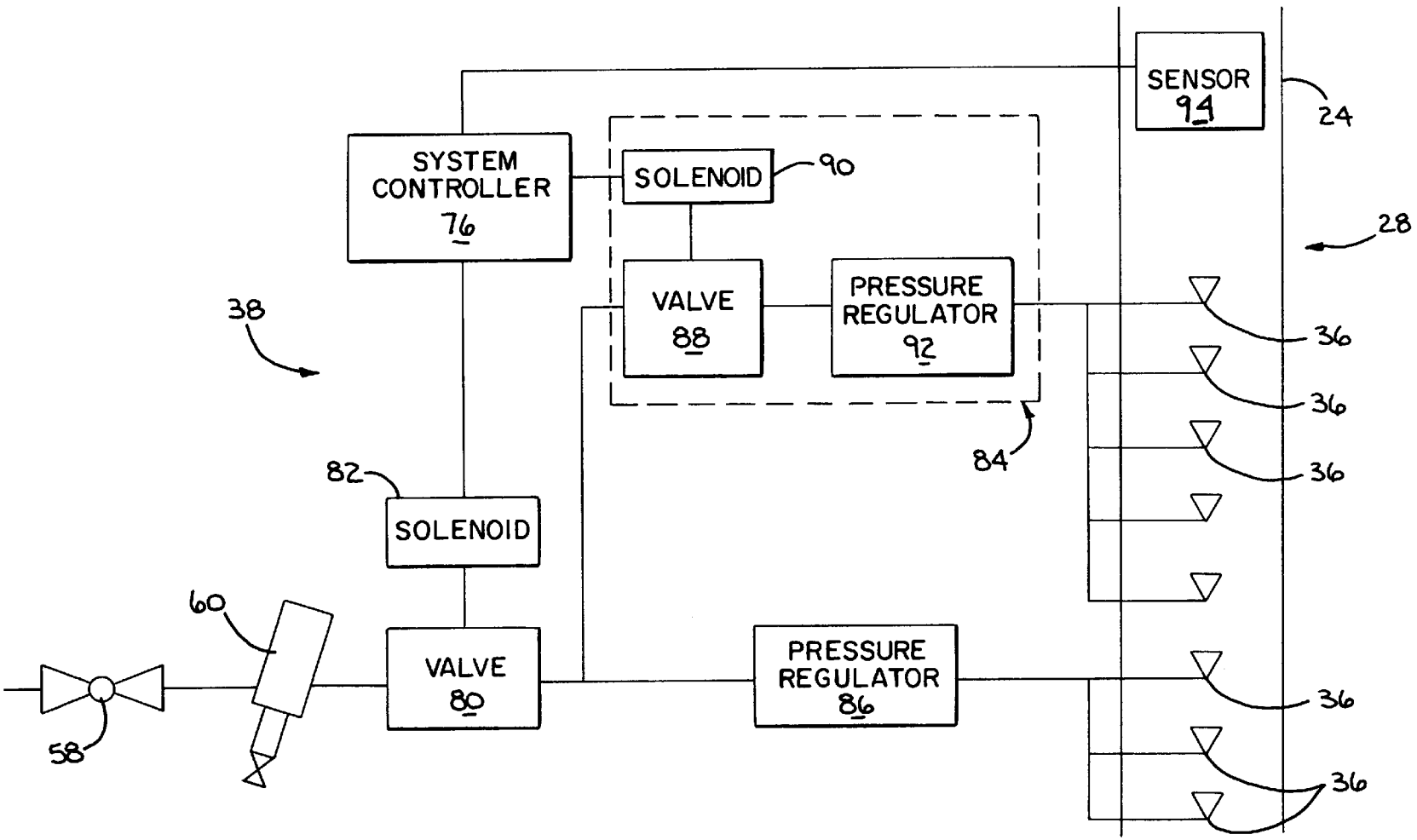
FIG. 6 is a schematic view of still another embodiment of a coolant pressure regulation and control system for use with the present invention wherein the pressure regulation and control system directly senses differences in the density of the vapor stream in a conduit to which the pressure regulation and control system is fitted.

Alternatively, as shown in FIG. 6, the pressure regulation and control system 38 may include a sensor 94, which is disposed at the inlet to the first straight section 24, and which determines the density of the vapor in the vapor stream entering the first coolant-to-fluid heat exchanger 28. In this embodiment, the system controller 76 may be configured to control the supply of the coolant according to the density of the vapor determined by the sensor 94 at the inlet to the first straight section 24, rather than according to the operation of the parts washer 12, as determined through the connection of the system controller 76 to the parts washer control circuit 78.

In operation, the vapor condenser 10 eliminates all visible steam from the vapor streams exiting the vapor condenser 10. For a stream with a temperature of 190 degrees F. as measured at the exhaust 16, the coolant, preferably water, entering the first coolant-to-fluid heat exchanger 28 at a rate of 5.25 gallons/min. during the wash cycle removes 207,500 BTU/hr from the stream, thereby lowering the temperature of the stream as measured at the outlet 18 to 107 degrees F. By contrast, the coolant enters the vapor condenser 10 at a temperature of 75 degrees F. and exits the release valve at 154 degrees F.

Alternatively, if the temperature of the coolant is lowered, the flow rate of the coolant can be decreased, while still achieving the same rate of heat removal.

Still other aspects, objects, and advantages of the present invention can be obtained from a study of the specification, the drawings, and the appended claims.

I claim:

1. A vapor condenser comprising:

a conduit defining a passage for guidingly communicating a vapor stream in a vapor flow direction from a first location to a second location;

a nozzle to disperse a first coolant in the passage;

means for selectively supplying the nozzle with the first coolant at a first pressure to produce a first first coolant flow rate in the passage and for selectively supplying the nozzle with the first coolant at a second pressure to produce a second first coolant flow rate in the passage;

means for determining that one of a) a first vapor state and b) a second vapor state exists in the passage; and means for controlling the coolant supplying means to supply the nozzle with the first coolant at the first pressure to produce the first first coolant flow rate in the passage as an incident of the determining means determining that the first vapor state exists in the passage, and to supply the nozzle with the first coolant at the second pressure to produce the second first coolant flow rate in the passage as an incident of the determining means determining that the second vapor state exists in the passage.

2. The vapor condenser according to claim 1, wherein in the first vapor state there is a first vapor density in the vapor stream and in the second vapor state there is a second vapor density in the vapor stream, the first and second vapor densities being different.

3. The vapor condenser according to claim 1, in combination with a parts washer having first and second operating states which cause the first and second vapor states in the vapor stream, said determining means determining the first vapor state as an incident of sensing the first operational state of the parts washer and determining the second vapor state as an incident of sensing the second operational state of the parts washer.

4. A vapor condenser comprising:

a conduit defining a passage for guidingly communicating a vapor stream in a vapor flow direction from a first location to a second location;

first and second nozzles to disperse a first coolant in the passage whereby vapor in the vapor stream is condensed;

means for selectively supplying the first nozzle with the first coolant to produce a first first coolant flow rate in the passage, and for selectively supplying the first and second nozzles with the first coolant to produce a second first coolant flow rate in the passage;

means for determining a) that one of a first vapor state and b) a second vapor state exists in the passage; and means for controlling the coolant supplying means to supply the first nozzle with the first coolant to produce the first coolant flow rate as an incident of the determining means determining that the first vapor state exists in the passage, and to supply the first and second nozzles with the first coolant to produce the second first coolant flow rate as an incident of the determining means determining that the second vapor state exists in the passage.

5. The vapor condenser according to claim 4, further comprising a means for inducing flow of the vapor stream in the vapor flow direction from the first location to the second location.

6. The vapor condenser according to claim 5, wherein said flow inducing means comprising means for generating a first pressure at the first location and a second pressure at the second location to draw the vapor stream from the first location to the second location.

7. A vapor condenser comprising:

a conduit defining a passage for guidingly communicating a vapor stream in a vapor flow direction from a first location to a second location;

a nozzle to disperse a first coolant into the passage between the first and second locations in a first coolant flow direction that is counter to the vapor flow direction;

means for selectively supplying the nozzle with the first coolant at a first pressure to produce a first first coolant flow rate in the passage, and for selectively supplying the nozzle with the first coolant at a second pressure to produce a second first coolant flow rate in the passage;

means for determining that one of a) a first vapor state and b) a second vapor state exists in the passage;

means for controlling the coolant supplying means to supply the nozzle with the first coolant at the first pressure to produce the first first coolant flow rate in the passage as an incident of the determining means determining that the first vapor state exists in the passage, and to supply the nozzle with the first coolant at the second pressure to produce the second first coolant flow rate in the passage as an incident of the determining means determining that the second vapor state exists in the passage; and means for delivering a second gaseous coolant into the passage between the first and second locations whereby vapor in the vapor stream is condensed.

8. A vapor condenser comprising:

a conduit defining a passage for guidingly communicating a vapor stream in a vapor flow direction from a first location to a second location;

first and second nozzles to disperse the first coolant into the passage between the first and second locations in a first coolant flow direction that is counter to the vapor flow direction whereby vapor in the vapor stream is condensed;

means for selectively supplying the first nozzle with the first coolant to produce a first first coolant flow rate in the passage, and for selectively supplying the first and second nozzles with the first coolant to produce a second coolant flow rate in the passage;

means for determining that one of a) a first vapor state and b) a second vapor state exists in the passage;

means for controlling the coolant supplying means to supply the first nozzle with the first coolant to produce the first first coolant flow rate in the passage as an incident of the determining means determining that the first vapor state exists in the passage, and to supply the first and second nozzles with the first coolant to produce the second coolant flow rate in the passage as an incident of the determining means determining that the second vapor state exists in the passage; and means for delivering a second gaseous coolant into the passage between the first and second locations whereby vapor in the vapor stream is condensed.

* * * * *